United States Patent [19]

Barret

[11] Patent Number: 4,811,498

[45] Date of Patent: Mar. 14, 1989

[54] SKI BOOT

[75] Inventor: Thierry Barret, Pringy-Gare, France

[73] Assignee: Salomon S. A., Annecy Cedex, France

[21] Appl. No.: 893,910

[22] Filed: Aug. 6, 1986

[30] Foreign Application Priority Data

Aug. 6, 1985 [FR] France ..... 85-12034

[51] Int. Cl.[4] ..... A43B 5/04; A43B 7/20

[52] U.S. Cl. ..... 36/117; 36/58.5; 36/89; 36/119; 128/611

[58] Field of Search ..... 36/117–121, 36/89, 58.2, 50, 92; 128/804, 166, 611

[56] References Cited

U.S. PATENT DOCUMENTS

| | | | |
|---|---|---|---|
| 2,935,798 | 5/1960 | Piberhofer | 36/92 |
| 3,522,668 | 8/1970 | Fesl | 36/89 X |
| 4,334,367 | 6/1982 | Salomon | 36/117 |
| 4,411,077 | 10/1983 | Slavitt | 36/89 |
| 4,441,265 | 4/1984 | Burns et al. | 36/117 |
| 4,489,719 | 12/1984 | Lapenskie | 128/804 |
| 4,534,123 | 8/1985 | Salomon | 36/117 X |
| 4,547,981 | 10/1985 | Thais et al. | 36/89 |
| 4,577,419 | 3/1986 | Chassaing | 36/89 |

FOREIGN PATENT DOCUMENTS

| | | | |
|---|---|---|---|
| 3336441 | 4/1984 | Fed. Rep. of Germany | 36/117 |
| 2499834 | 8/1982 | France | 36/117 |
| 2512646 | 3/1983 | France | 36/117 |
| 24854 | of 1898 | United Kingdom | 128/611 |

*Primary Examiner*—James Kee Chi

*Attorney, Agent, or Firm*—Pollock, Vande Sande & Priddy

[57] ABSTRACT

A sport boot, intended especially for cross country skiing, essentially flexible, has a front area (16) of the shaft (9) which is continuous and completely closed, with respect to which slits (19, 21) are offset, allowing the opening and closing of the shaft (9) so that the boot can be put on and taken off. On the inside of the boot (1) is attached, along a lateral area (33) of the sole, an end (32) of a strap (31) which bypasses the foot at the level of the metatarsals, then issues from the boot through a slit (40) placed in an area (27) located between the front area (16) of the shaft (9) and the slits (19, 21) to bypass the ankle joint between the lower level of the lower attachment of the Achilles tendon to the calcaneum and the lower level of the malleoli, overlapping the slits until it cooperates with means (41) for the tightening of the strap (31). The strap (31) ensures both placement of the foot flush against the sole (2) inside the boot, and closing of the shaft (9) with clamping of the ankle joint. A second strap may also be provided.

11 Claims, 3 Drawing Sheets

SKI BOOT

FIELD OF THE INVENTION

This invention pertains to a sport boot, of an essentially flexible nature, which is intended especially for cross country skiing.

BACKGROUND OF THE INVENTION

It is known that such a boot must meet a requirement of maximum flexibility, so that it presents only minimal restriction for foot movements, and a requirement for optimal fit of the sole of the boot with that of the foot, in a general manner so as to provide a high degree of stability for the user and, in the specific case of the cross country ski boot, to allow precise control of the ski by the foot.

To mitigate the possibility of ensuring such optimal fit through the intermediary of the upper and the shaft of such a boot, which are essentially flexible, it has already been proposed, for example, in U.S. Pat. No. 3,327,410, to attach in two opposite lateral areas of the boot sole, inside the latter, two straps which affix the boot sole to the foot by clamping the latter, and are independent of the binding and of the shaft of the boot so as not to interfere with their flexibility.

The two aforementioned requirements are thus met.

However, the boot described in U.S. Pat. No. 3,327,410 is not completely satisfactory.

Indeed, it can be noted that the path which the straps follow presents a certain number of problems; for each of the straps, this path comprises, beginning with the lateral area of the boot sole by which said strap is attached to the boot, a first ascending section running along the inside of the boot at the level of the cuneiforms and the scaphoid of a foot housed in this boot, then a second ascending section bypassing the instep, running along the inside of the boot first at the level of the cuneiforms and the scaphoid, on the side of the boot which corresponds to the lateral area of the sole, with which the strap under consideration is attached to this sole, then in front of the tibia on the other side of the boot, and finally, a third section which bypasses the ankle joint running along the inside of the boot at the level of the base of the tibia, to return in front of the instep immediately above the second section. The other strap follows an analogous path beginning with the opposite lateral area of the sole, and successively presents, beginning with this lateral area, a first ascending section running along the inside of the boot at the level of the cuneiforms and the scaphoid, a second ascending section running along the inside of the boot and bypassing the instep first at the level of the cuneiforms, then of the base of the tibia, crossing the second section of the first strap, then a third section, which almost totally bypasses the ankle joint at the level of the base of the tibia, to present in the front thereof an end which the user can fasten as desired to the corresponding end of the other strap to ensure a tightening of these two straps and, by this tightening, place the foot flush against the sole of the boot; the third section of the second strap almost totally covers the third section of the first strap which passes through the third section of the second strap through a slit therein to allow the mutual fastening of the respective ends of the two straps.

Because of tis path, the straps act on the foot, to place it flush against the sole, in an area corresponding to the cuneiforms, the scaphoid, and even the base of the tibia, which causes an oblique pressure to be applied to the foot towards the rear and downward, which further tends to apply the heel towards the rear against the joint between the base of the shaft and the boot sole so as to effectively apply the sole of the foot against the boot sole. Pivoting of the sole with respect to the foot, around the heel, occurs when this type of path is involved, which constitutes an appreciable inconvenience in the practice of all sports, and especially in that of cross country skiing, which requires the most precise possible control of the ski by means of the boot sole.

Moreover, the clamping of the ankle joint at the level of the base of the tibia, i.e., at the level of the tibia-tarsal clamp constitutes an impedance for the user to the extent that the opening of this clamp during extension movements of the foot are restricted; this inconvenience, which is generally appreciable, is quite especially bothersome in cross country skiing in that the extension of the foot constitutes one of the basic maneuvers in this sport.

In addition, the superposition of the respective third sections of the two straps and the need for one of them to cross the other makes it particularly inconvenient and tedious to place the straps around the feet. Moreover, because of this the straps are very long, thus, on the one hand, entailing the risks of tangling or folding thereof inside the boot when it is being put on, and, on the other hand, an appreciable cost for these straps.

Other disadvantages are related to the fact that the boot proposed by U.S. Pat. No. 3,327,410 presents, with the exception of the presence of the straps, a completely conventional structure, characterized especially by the presence of a front opening in the shaft and the upper so that the boot can be put on and taken off, with closing as desired by lacing, entirely independent from the clamping of the foot by the straps. In other words, putting the boot on while the straps are disengaged from each other and the shoe is unlaced requires, after the foot is introduced, first, the positioning of the straps and the mutual fastening thereof around the ankle joint, then the lacing of the boot, while taking the boot off requires first the unlacing of the boot, then the disengagement of the straps before the foot can be removed; putting the boot on and removing it are thus made relatively complicated due to the presence of the straps.

Moreover, the presence of the opening for putting on the boot provided with laces in a front area of the shaft and a major portion of the binding, i.e., in the area which is especially exposed to projections of snow in the case of a cross country ski boot, renders the type of boot proposed by U.S. Pat. No. 3,327,410 virtually unusable for cross country skiing; indeed, the extent is known to which the slightest opening placed in such an area in a cross country ski boot, even if it is simply a hole for the passage of a thread, allows moisture to enter the boot, and thus make this boot impossible to use.

SUMMARY OF THE INVENTION

The object of this invention is to overcome these problems and, for this purpose, the invention proposes a boot which comprises ar least one strap for clamping the foot as proposed by U.S. Pat. No. 3,327,410, but which results from a complete re-evaluation of the entire boot instead of consisting of simply a mounting of straps on a boot which in other respects is conventional, as proposed by the aforementioned U.S. patent.

The sport boot according to the invention, which is intended especially for cross country skiing and which comprises a flexible upper and a flexible shaft having a slit to allow the shaft to be opened for putting the boot on and taking it off, means for closing and opening the slit as needed and clamping means to clamp the foot in the boot, with said clamping means comprising at least a first clamping strap having a first end attached to the inside of the boot, in a first lateral area of the sole located on a first side of the boot, and, successively, beginning with this first end, a first section extending laterally along a foot housed in the boot, a second section bypassing the instep, a third section partially bypassing the rear of the ankle joint, and a second end cooperating with means for tightening and releasing the strap as desired, wherein the shaft presents a continuous flexible front area, which is completely closed and is offset with respect to which said slit, in that the first lateral area of the sole is located at a level which at least partially includes the metatarsals of the foot, the first and second sections of the first strap extending along the inside of the upper at a level which at least partially includes the level of the metatarsals, and the third section of the first scrap extends along the shaft essentially on the outside, between a lower limit level defined by the lower level of the lower attachment of the Achilles tendon to the calcaneum and an upper limit level defined by the lower level of the malleoli, and is connected to the second section by a first passage opening placed in the shaft on a second side of the boot, opposite said first side, between the front area of the shaft and the slit which the third section of the first strap overlaps, so that the tightening of the first strap simultaneously causes the foot to be clamped in the boot and the shaft to close, and that the release of the first strap simultaneously allows the shaft to be opened and the foot to be released Depending on the case, the means for tightening and releasing the first strap can comprise means for fastening and releasing the second end of this strap from the shaft, as desired, outside of the latter, or else can be comprised of a second strap for clamping the foot, having a first end attached to the inside of the boot, in a second lateral area of the sole located on the second side of the boot at a level at least partially including the level of the metatarsals, and, successively, from this first end on, a first section extending laterally along the foot, a second section bypassing the instep, with said first and second sections of the second strap running along the inside of the upper at a level which at least partially includes the metatarsals, a third section partially bypassing the ankle joint, running along the shaft essentially on the outside between said lower and upper limit levels, with said third section of the second strap being connected to the second section of the second strap by a second passage opening placed in the shaft on the first side of the boot, between the front area f the shaft and the slit, and a second end, and, on the other hand, means to mutually fasten and release the respective second ends of the first and second straps, as desired, outside of the boot, between the first and second passage openings and behind these, so that the third respective sections of the first and second straps complement one another to bypass the shaft through the rear between the first and second passage openings.

The passage of the first and second sections of the single strap or of each strap at a level at least partially including the level of the metatarsals allows the foot to be best placed flush downward against the boot sole while providing a maximum resistance to a pivoting of the front part of the foot with respect to the boot sole so that a totally effective mutual fastening is obtained, even for cross country skiing.

The passage of the third section of the single strap or of each of the two straps between the lower level of the malleoli and the lower level of the lower attachment of the Achilles tendon to the calcanea allows the prevention of any interference with the extension movement of the foot, which is also desirable, particularly for cross country skiing.

Thus, the boot according to the invention is characterized at once by good comfort and by an effective fitting together of the boot sole with the foot.

In addition, the overlapping of the opening slit of the shaft by the third section of the single strap or of one of the two straps allows this single strap or the two straps together to play a role in the closing of this slit, so that no other means for closing the shaft of the boot are necessary, especially when a low shaft boot is involved; or the provision only on an auxiliary basis of other closing means, for example, in the case of a high shaft boot. The process of putting the boot on and taking it off is thus considerably simplified; this possibility is compatible with the length of the single strap or of each strap being shorter than those of the straps required by the structure described in U.S. Pat. No. 3,327,410, because of the offsetting of the slit with respect to the front area of the shaft.

This offsetting also presents the advantage that the front area of the shaft can be completely closed, and hence easy to waterproof when a cross country ski boot is involved.

A boot according to this invention is thus also characterized by great simplicity of assembly and use.

BRIEF DESCRIPTION OF THE DRAWINGS

Other characteristics and advantages will emerge from the description below, pertaining to two embodiments for the boot according to the invention, as well as the attached drawings which are an integral part of this description.

Of course, although these drawings pertain to a cross country ski boot, this invention can be put into practice with other types of flexible boots intended for sports.

DETAILED DESCRIPTION

For the sake of simplicity, a description will be given of the two embodiments of the cross country ski boot according to this invention, which are illustrated respectively in FIGS. 1 and 3 and in FIG. 2 with reference to a regular normal movement position, with the boot being assumed to be resting upright on a horizontal plane, and according to a normal direction of forward movement.

Figure 1:
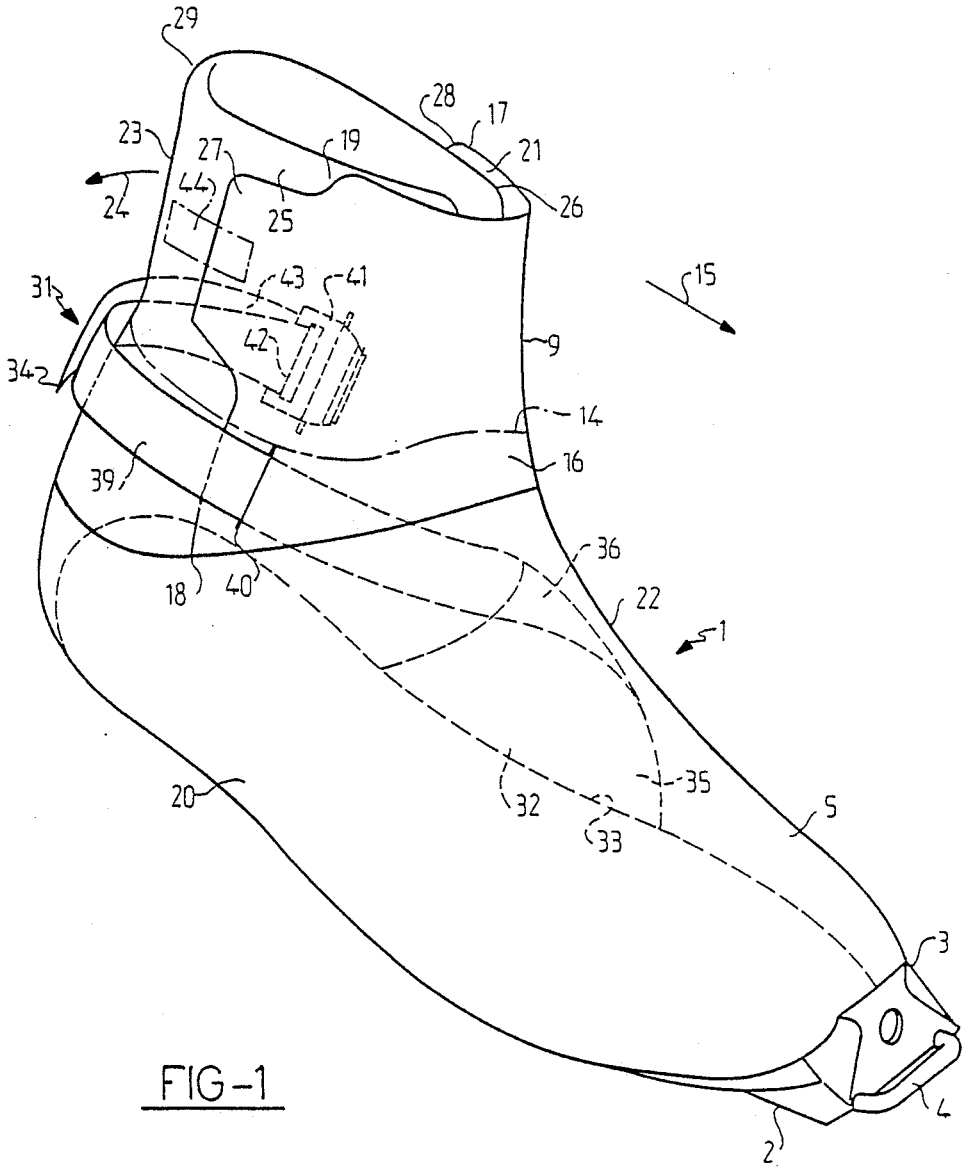
FIG. 1 shows a perspective view of a cross country ski boot according to the invention, with a single clamping strap.
Figure 3:
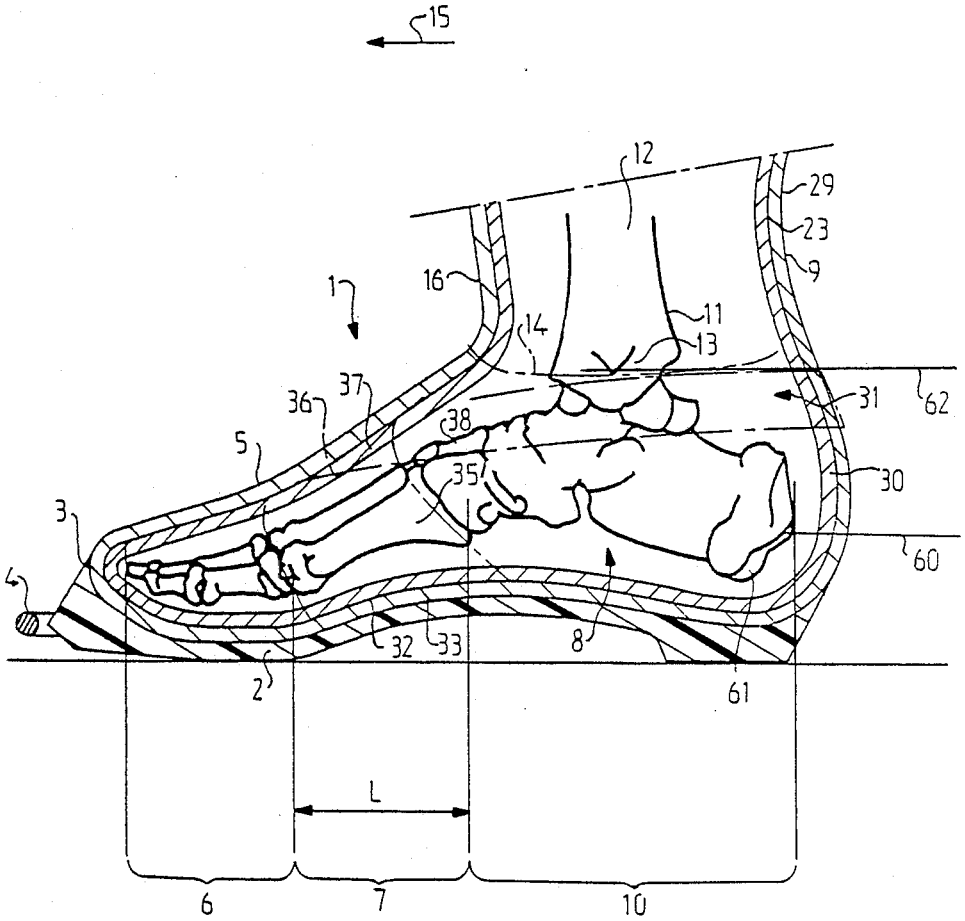
FIG. 3 illustrates the path of the strap with respect to the foot bones, with a view of the boot as in FIG. 1, cut by a vertical median plane, with the boot resting on a horizontal plane in position for normal use.

Reference will first be made to FIGS. 1 and 3, which illustrate a cross country ski boot 1 having a flexible sole 2 of the conventional type, provided in a front end area 3 with a ring 4 intended to cooperate with a cross country ski binding (not shown).

Towards the top, the sole 2 is solid with an upper portion 5 enveloping the phalanges 6 and the metatarsals 7 of a foot 8 housed inside the boot, and a shaft 9 enveloping the tarsals 10 of this foot 8 as well as a lower area 11 of the tibia 12 and the fibula (not shown), with this area 11 especially comprising the malleoli 13. This type of boot is called "high shaft", but the invention may also pertain to "low shaft" boots, with the shaft stopping below the malleoli 13, as shown in broken lines 14 in FIGS. 1 and 3.

According to the invention, whether the shaft is high or low, it presents towards the front, with reference to a normal direction 15 of forward movement, a continuous front area 16 which is completely closed, as well as the upper 5. Nonetheless, to allow the boot to be put on and taken off, the shaft 9 has, in a manner offset towards the rear with respect to its front area 16, at least one slit 19 extending from the top to the bottom of the upper limit or free end 17 of the shaft 9, up to a point 18 located at an intermediary level between that of the malleoli 13 and the sole 2. In the example illustrated in FIG. 1, the slit 19 is placed in a first side 20 of the boot 1, corresponding for example to the outer side of the foot, and a second slit 21 which also extends from the upper limit 17 of the shaft 9 to a point (not visible and not referenced) located approximately at the same level as point 18 is placed in the second side 22 of the boot, corresponding in this example to the inner side of the foot. Thus, slits 19 and 21 separate from the front area 16 of the shaft 9 a rear area 23 thereof, constituting a flexible flap which can be pivoted towards the rear, as shown by an arrow 24, with respect to the front area 16, opening slits 19 and 21 to facilitate the introduction or removal of the foot 8, and which can also be pushed forward to close slits 19 and 21 and enclose the lower area 11 of the tibia 12 and the fibula in the shaft 9 of the boot. Preferably, this closing of slits 19 and 21 is improved by the partial overlapping of lateral areas 25 and 26 of flap 23, located respectively on side 20 and side 22 of the boot 1, respectively by areas 27 and 28 of the shaft 9; said areas 27 and 28 laterally extend the front area 16 of the shaft 9 towards the rear, respectively of side 20 and side 22 of boot 1.

It would be possible, within the scope of the invention, to provide only one of slits 19 and 21, placing this single slit laterally like slits 19 and 21, or at the rear 29 of the shaft. Overlapping of this slit when closed would be advantageously provided, as was stated with respect to slits 19 and 21.

Advantageously, as illustrated, the boot 1 described above may be fully lined on the inside with a flexible slipper 30 attached to the sole 2 and the upper limit 17 of shaft 9, but in other respects is totally independent of the shaft 9 and of the upper 5 of boot 1.

According to this invention, the boot illustrated in FIG. 1 is provided with a flexible strap 31 for clamping the foot.

This flexible strap has a first end 32 which is located inside the boot, between the slipper 30 and the upper 5, and which is attached to the sole 2 along a lateral area 33 thereof, the second side 22 of the boot 1 in the example illustrated, and a second free end 34 which is located outside of the boot.

The lateral area 33 along which the first end 32 of the flexible strap 31 is attached to the sol 2 is located essentially at the level of the metatarsals 7 of the foot 8, as well as, in part, at the level of the cuneiforms 38, as seen in FIG. 3, and extends approximately over the entire length L of said metatarsals 7, as well as the first end area 32 of the strap 31.

Starting at its first end 32, the flexible strap 31 presents in succession the following sections:

(1) a first section 35 which runs along the inside of the boot 1, between, the upper 5 and the slipper 30, while remaining independent of both, said section 35 being located essentially at the level of the metatarsals 7 fitting flush with the latter over a maximum of the length thereof, potentially overlapping the level of the cuneiforms 38;

(2) a second section 36 bypassing the instep 37 and inserted freely between the upper 5 of the boot 1 and the slipper 30, essentially at the level of the metatarsals 7, with section 36 also fitting flush with the latter over a maximum of the length thereof, at least on the second side 22 of the boot 1, i.e., on the side of the first section 35 potentially overlapping the level of the cuneiforms 38 and/or the cuboid; from the first side 20 of the boot 1, the second section 36 bends, if it is assumed that the strap 31 is followed from its first end 32 to its second end 34, so as to overlap the level of the metatarsals 7 and that of the cuneiforms/cuboid 38, then crosses, approximately at the level of the cuneiforms/cuboid 38, a slit 40 placed near point 18 in area 27 laterally extending the front area 16 of shaft 9 on the first side 20 of the boot; the strap 31 can slide freely in opening 40, which on the other hand ensures that it is held in the upward sense;

(3) a third section 39 is located outside of the boot 1 and more precisely outside the shaft 9 thereof, with this third section 39 being connected by opening 40 to the second section 36; according to the present invention, this third section 29 bypasses the ankle joint by extending along the shaft 9 essentially on the outside, between the lower limit level 60 defined by the lower level of the lower attachment of the Achilles tendon to the calcaneum 61, and an upper limit level 62 defined by the lower level of the malleoli 13, and below the level of the upper limit 14 of the shaft 9 if a "low" shaft is involved; it will be noted that opening 40 is advantageously placed in a part of the area 27 of the shaft 9 which overlaps the area 25 of the flap 23 thereof, so that this opening 40 does not communicate the inside of the boot with the outside.

From opening 40 on, the third section 39 of the strap 31 successively overlaps, through the outside of the boot 1, a part of the area 27 located behind opening 40, then the flap 23 from the rear, successively overlapping slit 19 and slit 21, then a (non-reference) part of area 28 extending the front area 16 of the shaft 9 on the second side 22 of the boot, to cooperate with the means 41 connected to this area 28 approximately at the same level as the opening 40 but on the second side of the boot 1, and ensuring the connection with the area 28 or the release, as desired, of an area 42 of the strap 1 constituting the joint between the third section 39 thereof and a fourth section 43 adjacent to the free end 34 of the strap. Means 41, placed outside shaft 9 so as to be easily accessible for their manipulation, are, for example, comprised of a loop attached to area 28 and cooperating with area 42 of the strap 31 like a belt buckle. They can also comprise a single bypass loop for the strap 31, attached in area 28 and complemented by movable anchoring means for the free end 34 of the strap 31 on the third section 39 of this strap, on which the fourth section 43 must in this case be retracted to ensure the attachment.

It will be understood that the release of the strap 31 with respect to means 41 allows the flap 23 to be flipped back and strap 31 to be freed with respect to a sliding in the opening 40 as well as between the upper 5 of the boot 1 and slipper 30, to facilitate putting the boot on and taking it off, and that the tightening of strap 31 between its first end 32 attached along the lateral area 33 of sole 2 and the means 41 simultaneously ensures:

(1) tightening of the metatarsal 7 downward against the sole 2 and against the first side 20 of the boot 1, inside of said boot, and (2) retention of the flap 23 in a joining position with the front area 16 of the shaft, with the effective closing of slits 19 and 21 by the effective holding of areas 27 and 28, in superposition on areas 25 and 26. In the case of a high shaft boot, illustrated in solid lines in the drawings, this closing can be completed at an intermediate level between that of section 39 and that of the upper limit 17 of the shaft 9 by a conventional closing means 44, which respectively connect areas 27 and 28 to flap 23 while contributing to the holding of areas 27 and 28 which are applied against areas 25 and 26; these means 44 can, for example, be comprised of a fabric provided with loops and a series of hooks to be engaged in the loops, of the type distributed under the registered trademark "VELCRO", as well as potential movable anchoring means for the end 34 of the strap 31 on the third section 39 thereof.

Figure 2:
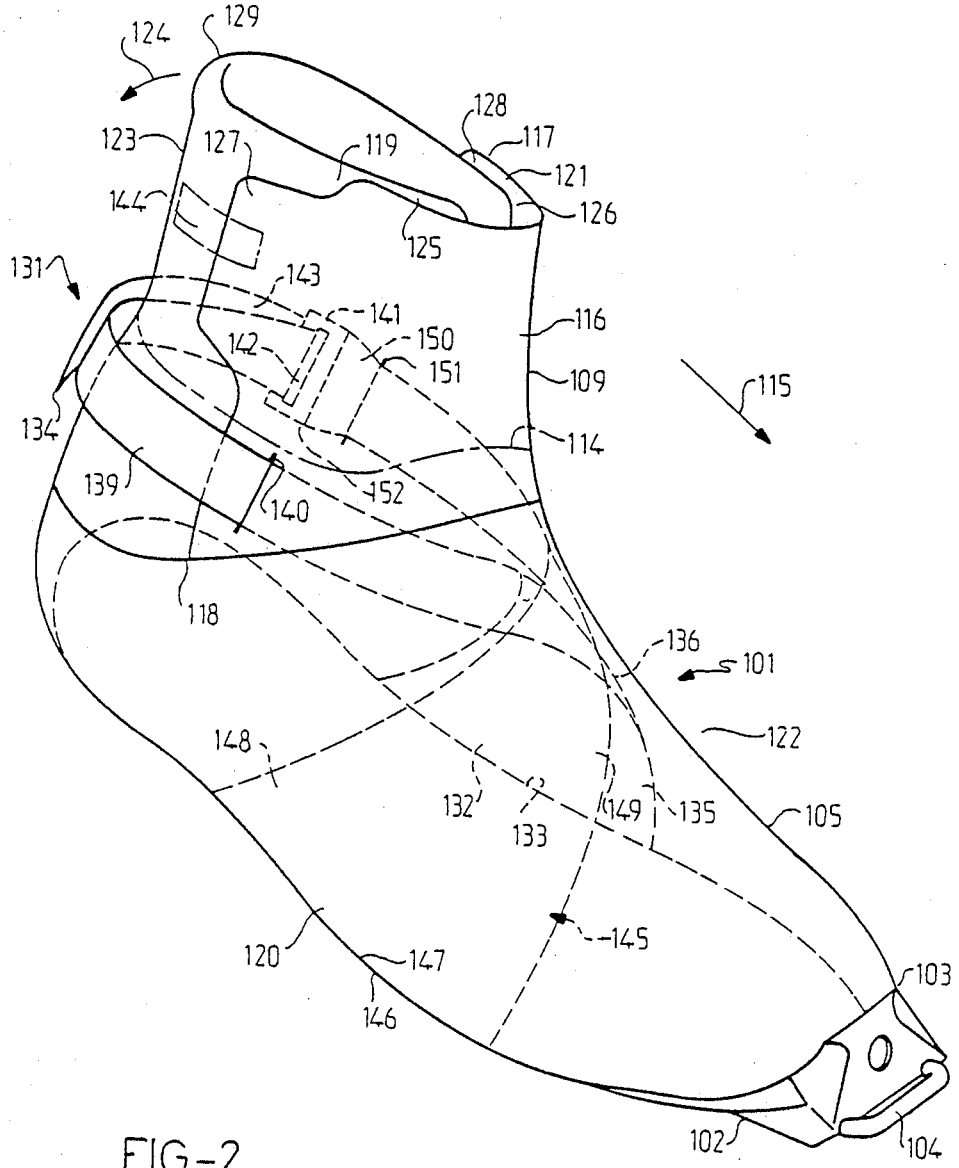
FIG. 2 shows an analogous view of a cross country ski boot according to the invention, with two clamping straps.

The embodiment of the invention illustrated in FIG. 2 has major analogies with that illustrated in FIG. 1, so that elements 1 to 5, 9, 14 to 29, 31 to 36, 39, 40 and 42 to 44 of the boot illustrated in FIGS. 1 and 3 are identical and those in FIG. 2 have been assigned the same references incremented by 100, namely, 101 to 105, 109, 114 to 129, 131 to 136, 139, 140, and 142 to 144.

The only difference between boot 101 illustrated in FIG. 2 and boot 1 illustrated in FIGS. 1 and 3 lies in the replacement of the fastening means 41 for area 42 of strap 31 with area 28 of shaft 9, by means 141 to fasten or release this area 142, as desired, with respect to a second flexible strap 145 which will now be described. It will be noted that these means 141 may be constituted in the same manner as the means 41 if it is merely in lieu of being fastened to area 128 corresponding to area 28, they are fastened to strap 145; reference can thus be made to the description of means 41 pertaining to the nature of means 141 and their cooperation with strap 131.

The second strap 145 provided in the embodiment illustrated in FIG. 2 has, like strap 131, a first end 146 by which it is attached to the sole 2, along a lateral area 147 thereof located opposite the lateral area 133 for fastening the first end 132 of the first strap 131, i.e., on the first side 120 of the boot 101, between the slipper (not shown) lining it on the inside and the upper 105 of this boot. As previously explained with reference to 132 of the strap 131 and the lateral area 133 of the strap 2, the first end 146 of the strap 145 and the lateral area 147 of the sole 2 extend essentially to the level of the metatarsals 7 (in FIG. 3) of a foot housed in the boot, approximately over the entire length (reference L in FIG. 3) of these metatarsals, potentially overlapping the level of the cuboid/cuneiforms 38.

Traced in the direction of an extension with respect to its first end 146, the second strap 145 presents the following succession of sections:

(1) a first section 148 extending along the inside of the boot between the upper 105 and the slipper, being independent from the latter; with this first section 148 ascending from the first end 146 of the strap 145, is in all respects comparable to the first section 135 of the first strap 131 and, like it, essentially extends approximately over the entire length of the metatarsal, potentially overlapping the level of the cuboid/cuneiforms 38;

(2) a second section 149 which is bent with respect to the first section 148, to bypass the instep between the upper 105 and the slipper, remaining mutually independent, with this second section 149 essentially fitting flush to a maximum extent with the metatarsals on the first side 120 of the boot, potentially overlapping the level of the cuboid/cuneiforms 38 and bending towards the rear to overlap the level of the metatarsals and that of the scaphoids on the second side 122 of this boot; this second section 149 is in all respects comparable to the second section 136 of the first strap 131 and crosses this second section 136 by being freely superposed thereon on the instep;

(3) a third section 150 located outside of the boot and connected to the second section 149 of the strap 145 by an opening 151 placed in area 128 extending from the side 122 of the boot the front area 116 of the shaft 109 thereof, with slit 151 occupying in area 128 a position analogous to that of slit 140 in area 127, i.e., to that of slit 40 in area 27. The third section 150 is thus located at the same level as section 139 of strap 131, i.e., also like area 142 of said strap 131, and defines for strap 145 a second end 151 holding in a fastened manner outside of the boot, the means 141 for fastening and releasing, as desired, cooperating with area 142 of strap 131; in the case of this embodiment, it is unimportant whether it is the third section 139 of strap 131 or the third section 150 of strap 145 which overlaps slit 121; it is only important that the respective third sections 139 and 150 of the two straps 131 and 145 complement each other to overlap the two slits 119 and 121, or the single slit potentially replacing them.

It will be understood that in the case of this embodiment, the mutual release of the two straps by means 141 allows the flipping 124 of the flap 123 towards the rear and the engagement or disengagement of the foot, and that the means 141 simultaneously assure, after the boot is put on, tightening of the two straps 131 and 145, i.e., the tightening of the foot laterally and against the sole 2 essentially at the metatarsal level, and the closing of the shaft 109 around the ankle joint; this closing may be supplemented, especially in the case of a high shaft boot, with means 144 in all respects comparable to the means 44 described above.

Of course, the slipper with which the boot 1 illustrated in FIGS. 1 and 3 and the boot 101 illustrated in FIG. 2 are provided on the inside is designed so as not to resist the opening of the shaft; advantageously, slits such as 19, 21, 119 and 121 are also placed in this slipper, which can advantageously have gussets opposite these slits.

What is claimed is:

1. Sport boot especially intended for cross country skiing and comprising a flexible upper and a flexible shaft (9, 109) presenting a slit (19, 21, 119, 121) allowing the shaft (9, 109) to be opened so that the boot can be put on and taken off, means (31, 41, 131, 145, 141) for closing and opening the slit (19, 119) as desired and means (31, 41, 131, 145, 141) for clamping the foot (8) in the boot (1, 101), with said clamping means (31, 41, 131, 145, 141) comprising a first clamping strap (31, 131) having a first end (32, 132) attached to the inside of the boot (1, 101) in a first lateral area (33, 133) of a sole (2, 102) of the boot, located on a first side (22, 122) of the boot (1, 101), and, successively, from this first end (32, 132) on, a first section (35, 135) extending along the side of a foot (8) housed in the boot (1, 101), a second section (36, 136) bypassing the instep (37)of the foot, a third section (39, 139) at least partially bypassing the rear of the ankle joint, and an area (43, 143) of the second end (34, 134) cooperating with means (41, 145, 141) for tightening and releasing the strap (31, 131) as desired, wherein (a) the shaft (9, 109) has a completely closed, continuous flexible front area (16, 116) with respect to which said slit (19, 119) is offset;

(b) the first lateral area (33, 133) of the sole (, 102) is located at a level at least partially including the level of the metatarsals (7) of the foot (8);

(c) the first and second sections (35, 36, 135, 136) of the first strap (31, 131) extend along the inside of the upper (15, 105) at a level which at least partially includes the level of the metatarsals (7); and (d) the third section (39, 139) of the first strap (31, 131) extends along the shaft (9, 109) essentially on the outside, between a lower limit level (60) defined by the lower level of the lower attachment of the Achilles tendon to the calcaneum (61) and an upper limit level (6) defined by the lower level of the malleoli (13), and is connected to the second section (36, 136) by a first passage opening (40, 140) placed in the shaft (9, 109) on a second side (20, 120) of the boot (1, 101), opposite said first side (22, 122), between the front area (16, 116) of the shaft (9, 109) and the slit (19, 119) that the third section (39, 139) of the first strap overlaps, so that tightening of the first strap (31, 131) simultaneously causes clamping of the foot (8) in the boot (1, 101) and closing of the shaft (9, 109), and so that the release of the first strap (31, 131) simultaneously allows opening of the shaft (9, 109) and release of the foot (8).

2. Boot according to claim 1, wherein the means for tightening and releasing the first strap (31) comprise means (41) to fasten and release, as desired, an area (42, 43) of the second end (34) of the first strap (31) with respect to the shaft (9), on the outside thereof.

3. Boot according to claim 3, wherein the means (41) to fasten and release said area (42, 43) of the second end (31) of the first strap (31) are located on the first side (22) of the boot (1) so that the third section (39) of the first strap (31) completely bypasses the shaft (9) through the rear between the first opening (40) and said means (41) to fasten and release, on the outside, between said lower and upper limit levels (60, 62).

4. Boot according to claim 3, wherein said slit (19) in the shaft (9) is located on the second side (20) of the boot (1), and the shaft (9) also has another slit (21) allowing the shaft (9) to be opened so that the boot can be put on and taken off, the said other slit (21) being located on the first side (22) of the boot (1), and said fastening and releasing means (41) being located between said other slit (21) and the front area (16) of the shaft (9) so that the third section (39) of the first strap (31) also overlaps said slit (21), between the first opening (40) and said fastening and releasing means (41).

5. Boot according to claim 1, wherein the means for tightening and releasing said first strap (131) comprise a second strap (145) for clamping the foot having a first end (146) attached to the inside of the boot (101), in a second lateral area (147) of the sole (108) located on the second side (120) of the boot (101) at a level which at least partially includes the level of the metatarsals and, successively, from this first end (146) on, a first section (148) extending along the side of the foot, a second section (149) bypassing the instep (37) of the foot, with said first and second sections (148, 149) of the second strap (145) extending along the inside of the upper (105) at a level which at least partially includes the level of the metatarsals (7), a third section (150) partially bypassing the ankle joint while extending along the shaft (109) essentially on the outside between said lower and upper limit levels (60, 62), said third section (150) of the second strap (145) being connected to the second section (149) of the second strap (145) by a second passage opening (151) placed in the shaft (109) on the first side (127) of the boot (101), between the front area (116) of the shaft (109) and the slit (119), and a second end (152), and means (141) for mutual fastening and release as desired of the areas (142, 143, 152) in the respective second ends (134, 159) of the first (131) and second (145) straps, outside of the boot (101), between the first (140) and second (151) passage openings and behind the latter, so that the third respective sections (139, 151) of the first and second straps (131, 145) complement each other to bypass the shaft (109) through the rear between the first and second passage openings (140, 151).

6. Boot according to claim 5, wherein said slit (119) of the shaft (109) is located on the second side (120) of the boot (101), wherein the shaft (109) also has another slit (121) allowing the shaft (109) to be opened so that the boot may be put on and taken off, and wherein said other slit (121) is located on the first side (122) of the boot (101), behind the second passage opening (151), so that the respective third sections (139, 150) of the first and second straps (131, 145) complement each other to also overlap said other slit (121).

7. Boot according to claim 5 or 6, wherein the respective second sections (139, 150) of the first and second straps (131, 145) overlap each other freely.

8. Boot according to any one of claims 1 to 6, wherein the first and second sections (35, 36, 135, 136, 142, 149) of the or each strap (31, 131, 145) are independent of the upper (5, 105).

9. Boot according to any one of claims 1 to 6, lined on the inside by a flexible slipper (30), the first and second sections (35, 36, 135, 136, 148, 149) of the or each strap (31, 131, 145) being inserted between the slipper (30) and the upper (5, 105).

10. Boot according to claim 9, wherein the first and second sections (35, 36, 135, 136, 148, 149) of the or each strap (31, 131, 145) are independent of the slipper (30).

11. Boot according to any one of claims 1 to 6, comprising auxiliary means (44, 144) for closing and opening each slit (19, 21, 119, 122) as desired.

* * * * *